US006315048B1

(12) United States Patent
Etzkorn

(10) Patent No.: US 6,315,048 B1
(45) Date of Patent: Nov. 13, 2001

(54) SYSTEM AND PROCESS FOR REDUCING THE FLOWING BOTTOM HOLE PRESSURE IN A NATURAL GAS WELL

(75) Inventor: Timothy E. Etzkorn, Tulsa, OK (US)

(73) Assignee: T-Bam Enterprises, LLC

( * ) Notice: Subject to any disclaimer, the term of this patent is extended or adjusted under 35 U.S.C. 154(b) by 0 days.

(21) Appl. No.: 09/398,730

(22) Filed: Sep. 17, 1999

(51) Int. Cl.[7] ..... E21B 43/34; E21B 43/18; E21B 43/00

(52) U.S. Cl. ..... 166/370; 166/267; 95/254; 96/184

(58) Field of Search ..... 166/369, 370, 166/267; 95/243, 253, 254; 96/182, 183, 184, 207, 215

(56) References Cited

U.S. PATENT DOCUMENTS 3,260,308 * 7/1966 Cryer ..... 166/267
3,863,714 * 2/1975 Watson, Jr. ..... 166/53
4,579,565 * 4/1986 Heath ..... 95/15
4,896,725 * 1/1990 Parker et al. ..... 166/267
4,948,393 * 8/1990 Hodson et al. ..... 95/250
5,785,123 * 7/1998 Lea, Jr. ..... 166/369

* cited by examiner

*Primary Examiner*—David Bagnell
*Assistant Examiner*—Jennifer M Hawkins
(74) *Attorney, Agent, or Firm*—Frank J. Catalano

(57) ABSTRACT

A system and process for reducing the flowing bottom-hole pressure in a natural gas well has a first discrete fluid flow path extending from the surface well head through a valve to an inlet of a separator, the valve being actuable between a closed condition and an open condition, and a second discrete gas flow path extending from an outlet of the separator to an inlet of a compressor, the compressor maintaining a near or below zero PSIG pressure at the separator inlet. When the valve is in the closed condition, positive pressure builds on the well head side of the valve and, when the valve is in the open condition, the near or below zero PSIG pressure of the separator is applied to the well head. In applications for receiving a fluid column of gas and liquid loading a plunger in the production line of a natural gas well, when the negative pressure is applied to the well head, the fluid column is transferred along the fluid flow path into the separator and the gas is transferred along the gas flow path from the separator to the compressor.

8 Claims, 3 Drawing Sheets

SYSTEM AND PROCESS FOR REDUCING THE FLOWING BOTTOM HOLE PRESSURE IN A NATURAL GAS WELL

BACKGROUND OF THE INVENTION

This invention relates generally to natural gas wells and more particularly concerns a system and process for reducing the flowing bottom hole pressure of a natural gas well by lowering the surface well head pressure.

The production rate of a natural gas well is a function of the pressure differential between the underground reservoir and the well head. This differential is adversely affected by back pressure against the reservoir pressure. Also, as natural gas and associated liquids are extracted during production, a gradual loss of reservoir pressure occurs in some natural gas wells. Natural gas wells can and do produce liquids, such as water and hydrocarbon. Removal of the produced fluids is dependent upon the velocity of the gas stream and, as the reservoir pressure and flow potential decrease, there is a corresponding drop in the flow velocity of the natural gas through the tubing to the well head. Eventually, when the flowing gas velocity becomes insufficient to overcome the "fall back" velocity of the liquids, a column of liquids accumulates in the well bore. The weight of the fluid column above the producing formation causes additional back pressure and a corresponding decrease in natural gas production. The back pressure caused by the liquid column in a typical well is approximately 0.4 psi per column foot.

In order to reduce the back pressure caused by the accumulation of produced fluids in the well bore, several artificial lift technologies have been utilized. In one such technology, commonly referred to as "plunger lift," a plunger acts as an artificial interface between the fluid column and the natural gas. This artificial lift technology utilizes a cyclic well operation with both shut-in and flowing time intervals. During the shut-in cycle of operation, a valve in the flow line is closed in order to increase the reservoir pressure at the well bore. During the subsequent producing cycle, the same valve is then opened to allow the plunger to travel from the base of the tubing to the well head. As the plunger rises, the fluid accumulated above the plunger is delivered to the surface and the hydrostatic pressure against the formation is reduced.

The success of "plunger lift" technology is dependent in part upon the comparative values of shut-in bottom hole pressure and flowing surface well head pressure. Well production rates are directly related to the pressure differential available between the shut-in bottom hole pressure and the flowing surface pressure. As the reservoir pressure declines, the significance of the flowing well head pressure increases. Reservoir pressure can decline to the point at which there is insufficient energy available to cause the plunger to travel to the surface against the existing flowing well head pressure. Failure of the plunger to effectively remove accumulated well bore fluids results in a drastic reduction in gas flow rate and even in a cessation of production.

A blow-down or venting method can be utilized to extend the productive life of a gas well in which performance is significantly affected by flowing well head pressure. This method allows the pressurized gas and fluid column present at the end of the shut-in period to flow to the surface ahead of the plunger into a liquid storage tank. Following the plunger arrival, the flow stream of natural gas is redirected through the surface equipment for conditioning and sale. During the blow-down or venting cycle, the natural gas volume above the plunger, together with any pollutants, is lost to the atmosphere. Additional energy is lost in forcing the produced liquids through the surface connections and piping into the storage tanks.

Natural gas production rates on wells equipped with "plunger lift" technology vary significantly. Wells are shut in for extended periods of time and, following shut-in, are allowed to produce utilizing the built-up energy or pressure accumulated during the shut-in period. The gas flow rate during the production period is not constant and generally decreases with time following plunger arrival. Natural gas well surface equipment and pipelines also contribute to pressure resistance at the well head. Gas pipelines operate under pressure and can exert a back pressure at the well head in an approximate range of from several pounds per square inch gauge (PSIG) to several hundreds of pounds per square inch gauge (PSIG). Typically, the pressure of the pipeline connection accounts for a significant portion of the producing surface back pressure. In order to reduce the pipeline back pressure on the well head, gas wells have been equipped with well site compression. Well site compression typically allows lowering the pressure of the surface equipment to an operating range of approximately 10 to 30 pounds PSIG, which represents the friction losses through the system and the gas flow stream pressure utilized to operate the equipment. One of the surface equipment functions is to separate liquids from the produced gas using the gas flow stream pressure to transfer recovered fluids to storage tanks. The liquid/gas separation equipment is typically of limited volume and sufficient pressure must be maintained to allow continuous transfer of produced fluids into the storage tanks.

It is, therefore, an object of this invention to provide a system and process for reducing the flowing bottom hole pressure of a natural gas well which minimize flowing well head surface pressure, preferably to a pressure approximating zero (0) PSIG. Another object of this invention is to provide a system and process for reducing the flowing bottom hole pressure of a natural gas well which uses surface equipment to reduce well head surface pressure. Similarly, it is an object of this invention to provide a system and process for reducing the flowing bottom hole pressure of a natural gas well which utilize well site compression, preferably capable of maintaining five (5) PSIG suction pressure or less through the full range of production rates from the well against existing pipeline pressures. It is also an object of this invention to provide a system and process for reducing the flowing bottom hole pressure of a natural gas well which have automation and sensing devices capable of responding to fluctuations in gas flow rates. A further object of this invention is to provide a system and process for reducing the flowing bottom hole pressure of a natural gas well which are capable of reduced performance during well shut-in periods. Still another object of this invention is to provide a system and process for reducing the flowing bottom hole pressure of a natural gas well which allows re-circulation of compressed natural gas. Yet another object of this invention is to provide a system and process for reducing the flowing bottom hole pressure of a natural gas well which utilize a liquid/gas sub-normal pressure separation vessel, preferably of sufficient volume to contain produced fluids during the plunger cycle at pressures approaching five (5) PSIG or less. A further object of this invention is to provide a system and process for reducing the flowing bottom hole pressure of a natural gas well which employ a mechanism by which produced fluid accumulated in a sub-pressure vessel can be transferred to an existing pressured separation vessel for processing and transfer to storage tanks. It is also an object of this invention to provide a system and process for reducing the flowing bottom hole pressure of a natural gas well which obviate the current practice of venting the pressurized gas to a stock tank. It is a further object of this invention to provide a system and process for reducing the flowing bottom hole pressure of a natural gas well which capture the pressurized gas above the plunger for sale. Yet another object of this invention is to provide a system and process for reducing the flowing bottom hole pressure of a natural gas well which provide for conservation of the natural resource and obviate the release of pollutants into the atmosphere. A further object of this invention is to provide a system and process for reducing the flowing bottom hole pressure of a natural gas well which improve efficiency of plunger lift wells, extend productive well life and recover additional reserves. And it is an object of this invention to provide a system and process for reducing the flowing bottom hole pressure of a natural gas well which improve the tandem performance of plunger lift equipment and onsite lease compression.

SUMMARY OF THE INVENTION

In accordance with the invention, a process and system are provided for use in natural gas production operations which separate natural gas and produced liquids under positive and/or negative pressures without use of pressure created by the natural gas flow stream and/or back pressure which is naturally or artificially created or maintained to transfer collected fluids during periods of natural gas flow. The process and system contemplate use of a vessel equipped with an inlet for receipt of the producing stream, an outlet for discharge of processed gas, storage capacity for retention of produced liquids and a liquid discharge outlet which may be equipped with a "dump" valve in association with a liquid level device.

Liquids may be transferred from this vessel to and/or for processing, use, sale, storage, transport, discharge, disposal or other purposes by a pump which may operate while the vessel is actively processing a natural gas flow stream or during periods when the vessel or portion of the vessel is effectively isolated from the natural gas flow stream. This may or may not include the use of any liquid level monitoring apparatus. A liquid level device such as a float may be combined with the liquid dump valve to regulate fluid discharge and reduce or eliminate the incidental transfer of natural gas with the produced liquid. The pump would be capable of developing a positive discharge pressure while transferring liquid from the vessel operating at near or less than atmospheric conditions. Any known power source can be used for the pump, such as an electric motor, a natural gas combustion engine or hydraulic and/or natural gas pressure.

Liquids may alternately be transferred from or to the vessel for processing, use, sale, storage, transport, discharge, disposal or other purpose by subjecting the vessel to either a positive or negative pressure during periods when the vessel is effectively isolated from the natural gas flow stream.

Such transfers of collected fluids will not cause an increase in the flowing pressure of the natural gas stream. This process is designed for continuous and/or intermittent flow processing conditions. Intermittent flow processing utilizes one vessel and continuous flow processing may utilize one vessel or may utilize two vessels installed in parallel flow paths.

The process and system can be used with or without the aid of wellhead compression for natural gas wells flowing gas and liquid continuously or intermittently through surface equipment, for natural gas wells with a plunger lift intermittently flowing gas and liquid through surface equipment, or for oil or gas wells with an artificial lift flowing gas and liquid from the casing through surface equipment.

In a preferred application of the process, a discrete fluid flow path is provided from the surface well head through a valve to an inlet of a separator and a discrete gas flow path is provided from an outlet of the separator to an inlet of a compressor. The compressor is operated to maintain a near or below zero PSIG pressure at the separator inlet and the valve is opened to reduce the pressure at the well head.

When the process is used to remove a fluid column of liquid and gas loading a plunger in a production line of a gas well having a positive downhole pressure, the discrete fluid flow path is provided from a well head end of the production line through a valve to an inlet of a separator and the discrete gas flow path is provided from an outlet of the separator to an inlet of a compressor. The compressor is operated to maintain a pressure near or below zero PSIG at the separator inlet. A flow line valve is normally closed to build bottom hole pressure. The valve is opened to allow the plunger to rise in the tubing and convey the fluid column along the fluid flow path into the separator.

The compressor continues operating to maintain a near or below zero PSIG pressure at the separator inlet to convey the gas along the gas flow path from the separator to the compressor.

In a preferred embodiment of the system, a first discrete fluid flow path extends from the well head outlet through a valve to an inlet of a separator, the valve being actuable between a closed condition and an open condition, and a second discrete gas flow path extends from an outlet of the separator to an inlet of a compressor, the compressor maintaining a pressure near or below zero PSIG at the separator inlet.

When the valve is in the closed condition, positive pressure builds on the well head side of the valve and, when the valve is in the open condition, the pressure near or below zero PSIG of the separator is applied to the well head. In applications for receiving a fluid column of gas and liquid loading a plunger in the tubing of a natural gas well, when pressure near or below zero PSIG is applied to the well head, the fluid column is transferred along the fluid flow path into the separator and the gas is transferred along the gas flow path from the separator to the compressor. dr

BRIEF DESCRIPTION OF THE DRAWINGS

Other objects and advantages of the invention will become apparent upon reading the following detailed description and upon reference to the drawings in which.

DETAILED DESCRIPTION

Figure 1C:
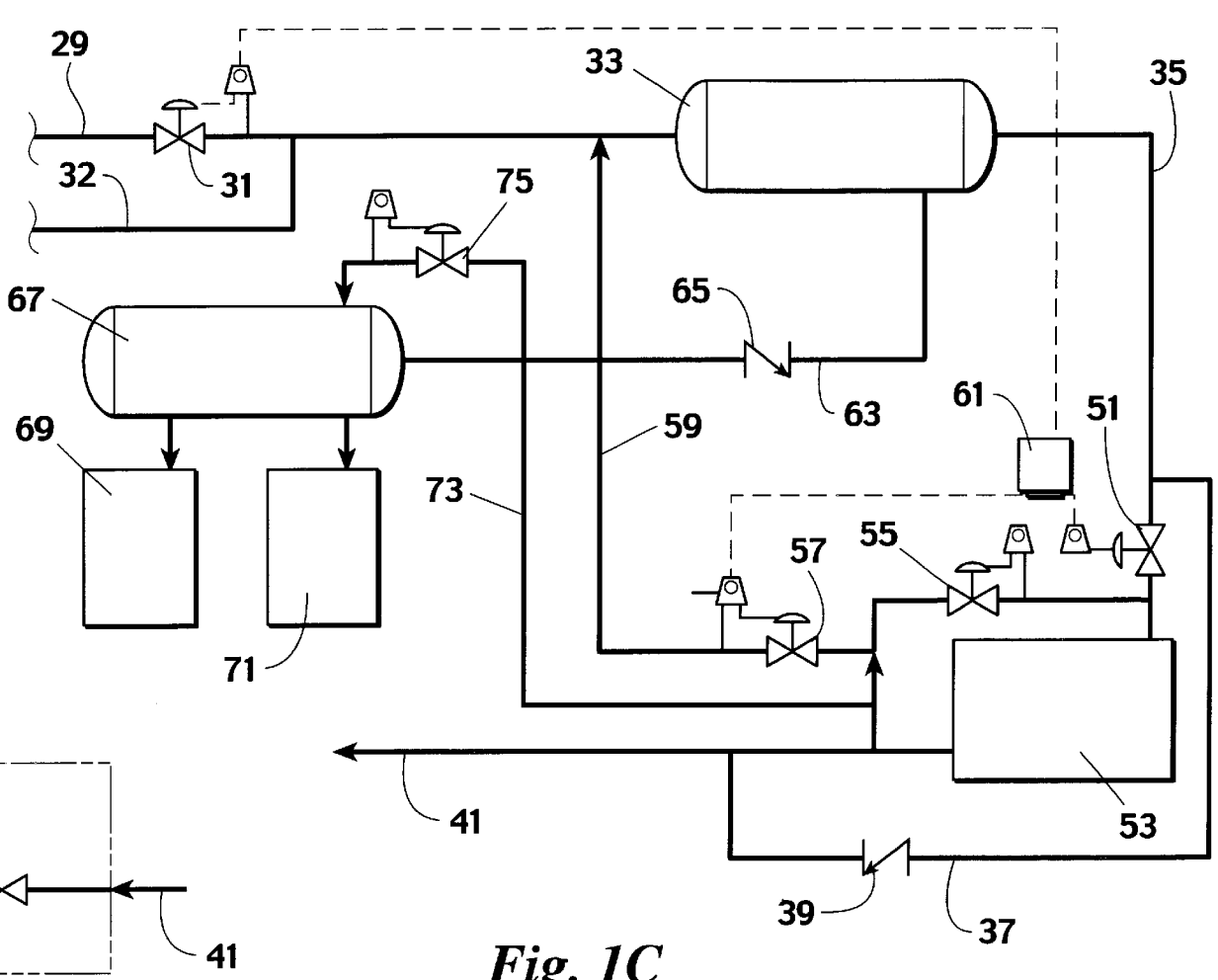
FIG. 1 is a schematic diagram illustrating a preferred embodiment of the system of the present invention.
Figure 1A:
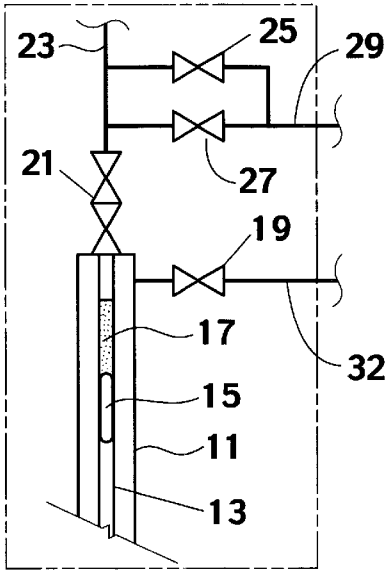
Fig. 1A ( PRIOR ART )
Figure 1B:
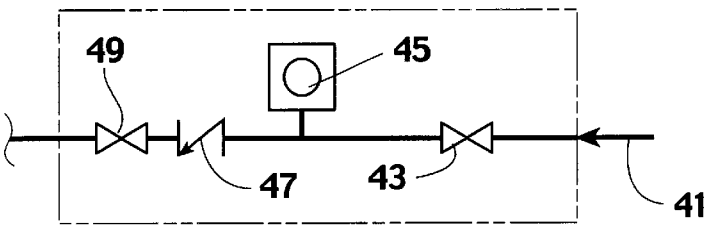
Fig. 1B ( PRIOR ART )

Turning first to FIG. 1, a preferred embodiment of a system for increasing the downhole to well head pressure differential in a natural gas well is illustrated in relation to an application in which a plunger is used to remove accumulated fluids from the well bore. The system is also usable, however, in other applications, such as using pressure from a well annulus to evacuate a separator.

As shown, the well bore 11 of a natural gas well has a production line tubing 13 forming an annulus between the well bore 11 and the tubing 13. The plunger 15 slides in the tubing 13. A fluid column 17, consisting of collected liquids and gases, extends upwardly in the tubing 13 from the plunger 15. A valve 19 is provided to isolate the annulus and master valves 21 are provided in the production line tubing 13 of the well head. A plunger catcher 23 extends above the master valves 21 to facilitate the catching, lubrication, retrieval, replacement and release of the plunger 15. As shown, the catcher 23 extends between a fluid column release valve 25 and a gas production valve 27. Manual valves 25 and 27 permit isolation of various portions of the flow path. If sufficient pressure is built up below the plunger 15, when the fluid column release valve 25 is opened, the plunger 15 will rise into the plunger catcher 23 and the fluid column 17 will be released through the fluid column release valve 25 into the flow line 29. When the plunger 15 has been fully received in the plunger catcher 23 and the fluid column 17 has been transferred into the flow line 29, the fluid column valve 25 is closed and the gas production valve 27 is opened. Gas production then continues through the tubing 13 from the downhole formation through the production valve 27 and into the flow line 29. This is typical of prior art plunger applications.

The system of the present invention is connected to the flow line 29. A motor controlled valve 31 automatically executes the manual functions of the release and production valves 25 and 27. The flow line 29 continues to a sub normal pressure separator 33. As shown, the outlet side of the annulus valve 19 may also be connected by line 32 to the separator 33 for reasons hereinafter discussed. A gas outlet line 35 extends from the separator 33 via a bypass line 37 containing a check valve 39 to the sales discharge line 41. The check valve 39 assures that there will be no flow in the bypass line 37 toward the sub normal pressure separator 33.

The production output of the sales line 41 of the invention may be delivered to any described handling system. The handling system shown is typical of the prior art and includes a sales line master valve 43, the output of which is measured by a sales line flow meter 45. A check valve 47 protects the flow meter 45 from reverse flow in the sales discharge line 41 and another valve 49 downstream of the flow meter check valve 47 permits isolation of the flow meter 45 between the isolation valve 49 and the master valve 43.

The gas outlet line 35 also extends from the sub normal pressure separator 33 to another valve 51 connected in parallel with the bypass line 37. Preferably, the valve 51 is a motor controlled valve whose outlet is connected to the inlet of a compressor 53. The compressor 53 is capable of maintaining suction pressure near or below zero PSIG, throughout the full range of the production capability of the gas well into a relatively stable pipeline pressure. The capacity of the compressor 53 can be varied by varying at least one of several criteria, including, among others, the rpm of the compressor prime mover, the internal loading in the compressor and/or the gear ratio between the prime mover and the compressor. An ARROW 330 natural gas fired prime mover combined with a FRICK 151 variable volume ratio rotary screw compressor is suitable. The compressor output flows into the sales discharge line 41 downstream of the bypass line check valve 39. Thus, the bypass line check valve 39 prevents flow from the outlet of the compressor 53 back to the gas outlet of the sub normal pressure separator 33. Another valve 55, also preferably motor controlled, is connected in a feedback path from the outlet of the compressor 53 to the inlet of the compressor 53 downstream of the compressor inlet valve 51. When the compressor inlet valve 51 is closed and the feedback valve 55 is opened, gas continuously flows to the compressor 53. Also, the separator inlet valve 31 and the compressor inlet valve 51 can be closed to isolate the separator 33 and allow use of well annulus pressure to evacuate the separator 33 by opening the annulus valve 19.

The feedback line is also connected upstream of the feedback valve 55 through another valve 57, preferably motor controlled, to the flow line 29 downstream of the separator inlet valve 31 to allow the compressor 53 to pressurize the sub normal pressure separator 33. As shown, the separator inlet valve 31, the compressor inlet valve 51 and the repressure valve 57 are all controlled by a single controller 61 which senses the performance pressures of the system. When the sub normal pressure separator 33 is pressurized via the repressure line 59 extending from the repressure valve 57, the liquids contained in the sub normal pressure separator 33 are conveyed through the liquid outlet line 63 and a check valve 65. When there is more than one liquid exhausted from the sub normal pressure separator 33, a pressure separator 67 is used. For example, as shown, if the liquids include water and oil, the liquids exhausted into the pressure separator 67 are separated into a water tank 69 and an oil tank 71. If only one liquid were being exhausted from the sub normal pressure separator 33, then the liquid outlet line 63 would be connected through the check valve 65 directly to a single storage tank.

As shown, it may also be desirable to connect the feedback line 73 of the compressor 53 through another valve 75, preferably motor controlled, to provide operating pressure to the pressure separator.

Figure 2A:
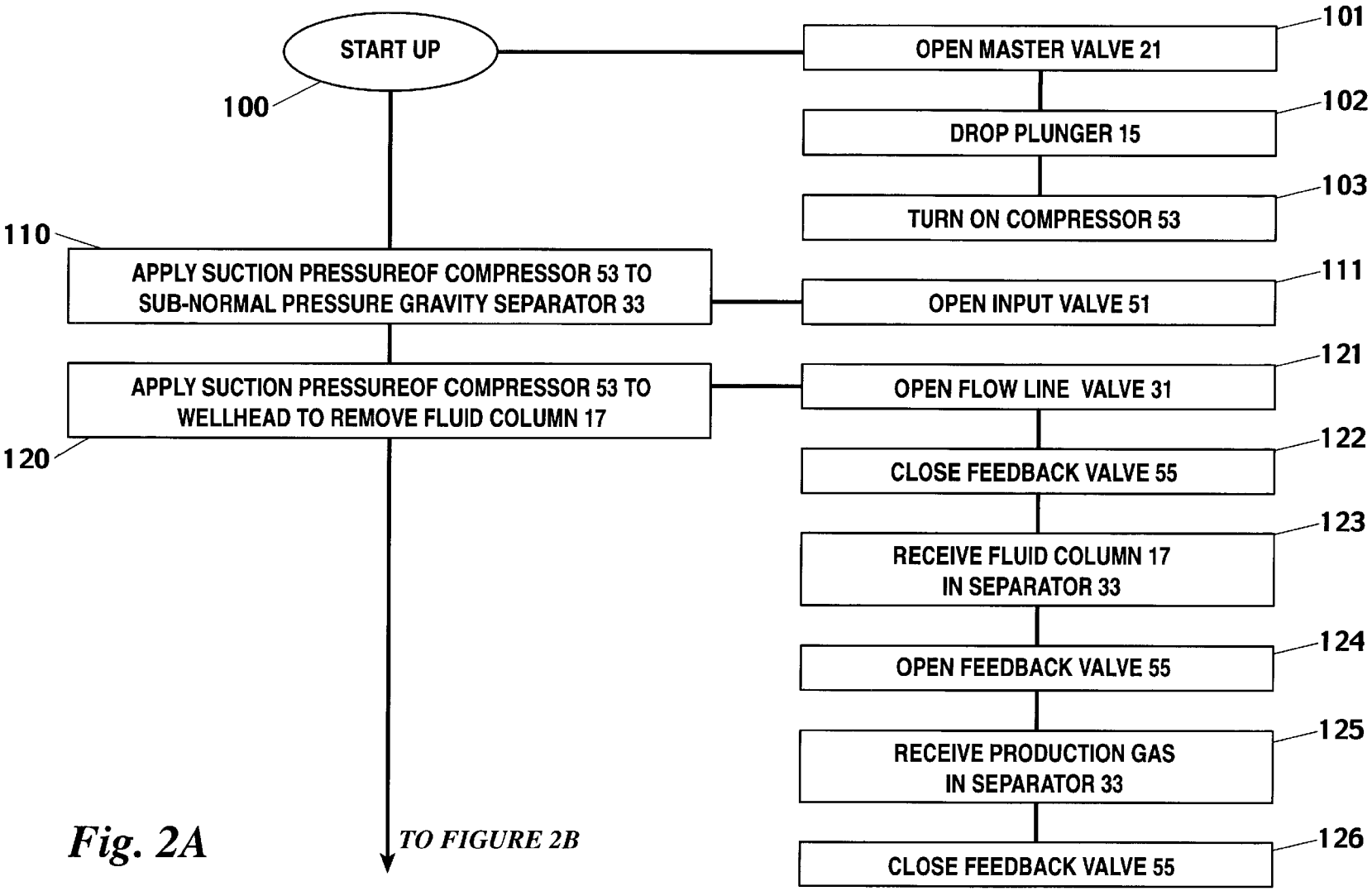
FIG. 2 is a flow chart illustrating a preferred embodiment of the process of the present invention.
Figure 2B:
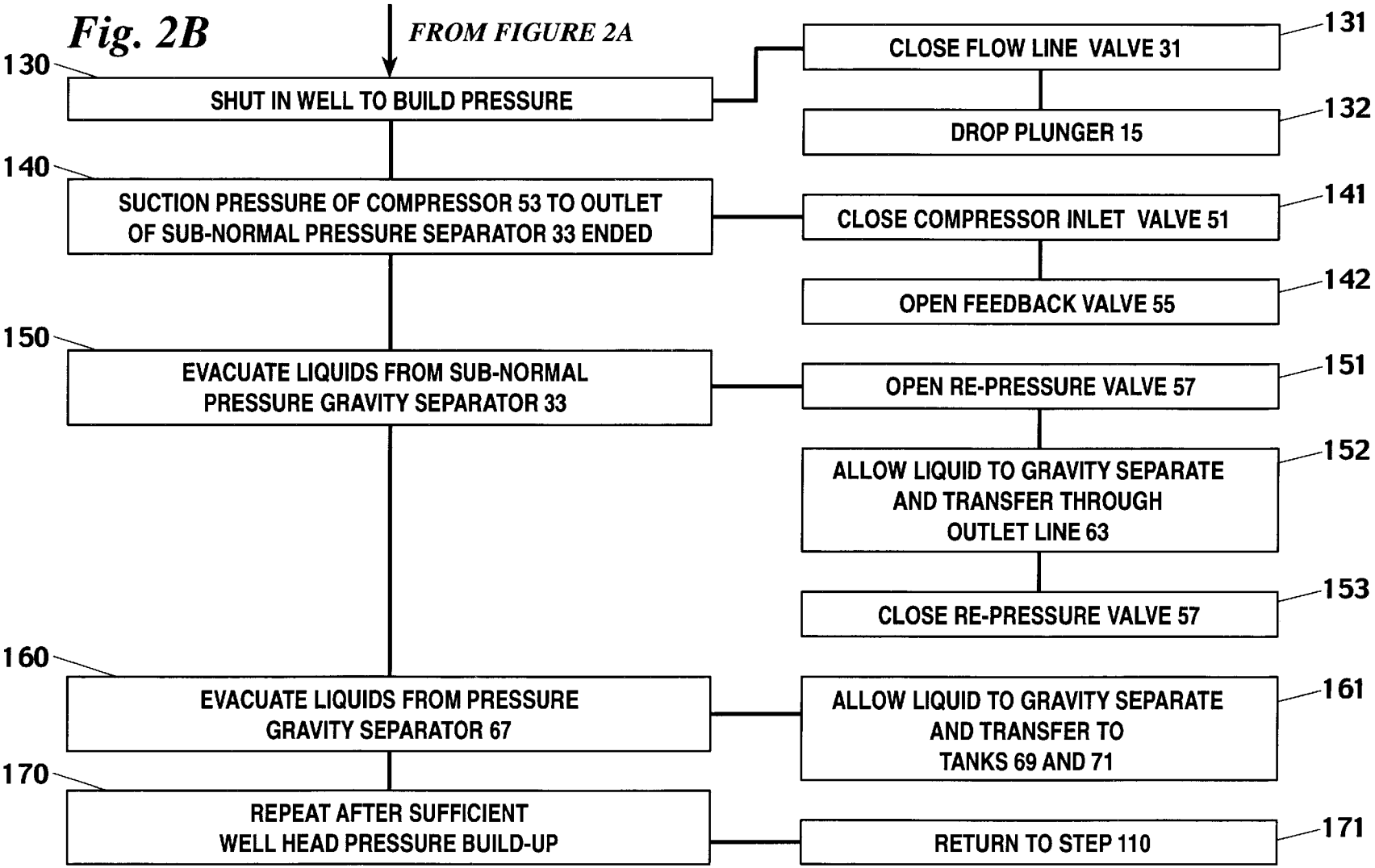

Turning to FIG. 2, the process of the present invention can be understood. The system is started up 100 by opening 101 the master valve 21, dropping 102 the plunger 15 and turning on 103 the compressor 53. The suction pressure of the compressor 53, which is near or below zero PSIG, is applied 110 to the sub-normal pressure gravity separator 33 by opening 111 the compressor inlet valve 51. The system pressure is also applied 120 to the wellhead to remove the fluid column 17 by opening 121 the separator inlet valve 31, closing 122 the feedback valve 55, receiving 123 the fluid column 17 in the separator 33, opening 124 the feedback valve 55, receiving 125 the production gas in the separator 33 and closing 126 the feedback valve 55. The well is shut in 130 to build pressure by closing 131 the separator inlet valve 31 and dropping 132 the plunger 15. The suction pressure of the compressor 53 to the outlet of the separator 33 is ended 140 by closing 141 the compressor inlet valve 51 and opening 142 the feedback line valve 55. Operation of the compressor 53 through the feedback valve 55 continues. Liquids are evacuated 150 from the separator 33 by opening 151 the repressure valve 57, allowing 152 accumulated liquid to transfer through the outlet line 63 and closing 153 the repressure valve 57. Liquids are evacuated 160 from the pressure gravity separator 67 by allowing 161 liquids to gravity separate and transfer to tanks 69 and 71. The cycle is repeated 170 after sufficient wellhead pressure is built up by returning 171 to step 110.

Depending on the volume of liquids collected in the sub-normal pressure separator 33 and the pressure separator 67, it may be possible to proceed from shut in 130 to build up the well head pressure directly to repeat 170 the process.

Thus, it is apparent that there has been provided, in accordance with the invention, a process and system that fully satisfy the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use in increasing a downhole to well head pressure differential of a natural gas well, a process comprising the steps of:

providing a discrete fluid flow path from a well head end of the well through a valve to an inlet of a separator;

providing a discrete gas flow path from an outlet of the separator to an inlet of a compressor;

operating the compressor to maintain near zero or below PSIG pressure at the separator inlet;

opening the valve to reduce the pressure at the well head.

2. The process of claim 1 said operating step comprising the substeps of:

sensing the compressor inlet pressure; and varying at least one of:

(a) the rpm of the compressor prime mover;

(b) the external loading on the compressor; and (c) the gear ratio between the prime mover and the compressor.

3. For use in removing a fluid column of liquid and gas loading a plunger in a production line of a gas well having a positive downhole pressure, a process comprising the steps of:

providing a discrete fluid flow path from a well head end of the production line through a valve to an inlet of a separator;

providing a discrete gas flow path from an outlet of the separator to an inlet of a compressor;

operating the compressor to maintain near zero or below PSIG pressure at the separator inlet;

opening the valve to allow the plunger to rise in the production line and convey the fluid column along the fluid flow path into the separator; and continuing to operate the compressor to maintain a near or below zero PSIG pressure at the separator inlet to convey the gas along the gas flow path from the separator to the compressor.

4. For use in removing a fluid column of liquid and gas loading a plunger in a production line of a gas well having a positive downhole pressure, a process comprising the steps of:

providing a discrete fluid flow path from a well head end of the production line through a valve to an inlet of a separator;

providing a discrete gas flow path from an outlet of the separator to an inlet of a compressor;

operating the compressor to maintain a near or below zero PSIG pressure at the separator inlet;

closing the valve to build positive pressure on a well head side of the valve to resist upward movement of the plunger;

opening the valve to allow the plunger to rise in the production line and vent the fluid column along the fluid flow path into the separator; and continuing to operate the compressor to maintain a near or below zero PSIG pressure at the separator inlet to convey the gas along the gas flow path from the separator to the compressor.

5. A system for increasing a differential between downhole and well head pressure in a natural gas well comprising:

a separator;

a discrete fluid flow path extending from a well head of the natural gas well through a valve to an inlet of said separator, said valve being actuable between a closed condition and an open condition;

a compressor;

a discrete gas flow path from an outlet of said separator to an inlet of said compressor;

said compressor maintaining a near or below zero PSIG pressure at said separator inlet, whereby, when said valve is in said closed condition, positive pressure builds on a well head side of said valve and, when said valve is in said open condition, the near or below zero PSIG pressure of said separator is applied to the well head.

6. A system according to claim 5, said compressor having at least one of:

a variable speed prime mover;

a variable internal loading; and a variable gear ratio between said prime mover and said compressor.

7. A system for removing a fluid column of liquid and gas loading a plunger in a production line of a gas well having a positive downhole pressure comprising:

a separator;

a discrete fluid flow path extending from a well head end of the production line through a valve to an inlet of said separator, said valve being actuable between a closed condition and an open condition;

a compressor;

a discrete gas flow path from an outlet of said separator to an inlet of said compressor;

said compressor maintaining a near or below zero PSIG pressure at said separator inlet, whereby, when said valve is in said closed condition, positive pressure builds on a well head side of said valve opposing upward movement of the plunger and, when said valve is in said open condition, the plunger rises in the production line and the fluid column is transferred along said fluid flow path into said separator and the gas is transferred along said gas flow path from said separator to said compressor.

8. A system according to claim 7, said separator having a gravity discharge for exhausting the liquid therefrom.

* * * * *